US006146699A

United States Patent [19]

Bonicel et al.

[11] Patent Number: 6,146,699

[45] Date of Patent: Nov. 14, 2000

[54] CABLE COVERED IN SOLID LUBRICANT

[75] Inventors: Jean-Pierre Bonicel, Malmaison, France; Olivier Tatat, Hickory, N.C.

[73] Assignee: Alcatel, Paris, France

[21] Appl. No.: 09/159,588

[22] Filed: Sep. 24, 1998

[30] Foreign Application Priority Data

Sep. 25, 1997 [FR] France ..... 97 11938

[51] Int. Cl.[7] ..... B05D 3/02; B05D 3/14; B05D 5/08; B05D 1/38

[52] U.S. Cl. ..... 427/299; 427/472; 427/180; 427/248.1; 427/314; 427/384; 427/372.2; 427/424; 427/402; 427/434.6; 427/446; 427/204; 72/42; 72/43

[58] Field of Search ..... 427/461, 204, 427/472, 569, 180, 248.1, 299, 314, 384, 372.2, 424, 402, 434.2, 434.446; 72/41, 42, 43, 46; 184/14; 174/110 SR, 110 N, 110 PM, 110 FC, 110 S, 120 SR

[56] References Cited

U.S. PATENT DOCUMENTS

| | | | |
|---|---|---|---|
| 3,828,890 | 8/1974 | Schott et al. | 184/15 R |
| 4,414,917 | 11/1983 | Bentley et al. | 118/695 |
| 4,749,059 | 6/1988 | Jonnes et al. | 184/15.1 |

FOREIGN PATENT DOCUMENTS

| | | |
|---|---|---|
| 0 144 905 A2 | 6/1985 | European Pat. Off. . |
| 3429 745 A1 | 2/1986 | Germany . |

*Primary Examiner*—Shrive Beck
*Assistant Examiner*—Michael Barr
*Attorney, Agent, or Firm*—Sughrue, Mion, Zinn, Macpeak & Seas, PLLC

[57] ABSTRACT

The invention relates to apparatus for depositing a lubricant coating on a cable, the cable including a sheath made by means of an extruder followed by a cooling vessel. Downstream from the cooling vessel, the apparatus includes a heater member followed by a deposition chamber for depositing a lubricant material.

13 Claims, 1 Drawing Sheet

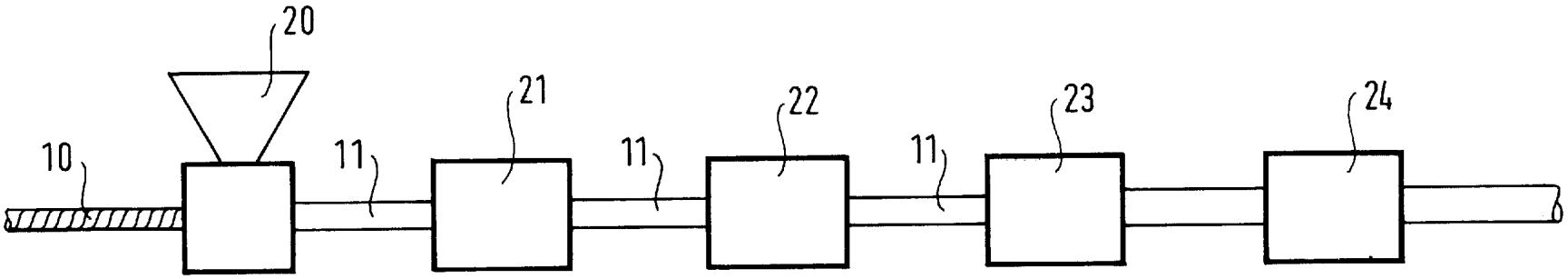
20
10
11
21
11
22
11
23
24

CABLE COVERED IN SOLID LUBRICANT

The present invention relates to a cable covered in solid lubricant, with such a cable being designed for installation in a tubular cable duct or conduit.

BACKGROUND OF THE INVENTION

In numerous fields of application, and in particular telecommunications, electric or fiber optic cables are inserted into ducts. There is therefore a need to minimize the coefficient of friction between cables and the inside walls of ducts.

A first known solution appears in French patent FR 2 674 364. In that document, the core of the cable passes via a first extruder which applies a conventional sheath thereto, often made of polyethylene. The sheathed core then passes through a second extruder which applies a composite lubricant layer thereto, such as an alloy of silicone resin and polyethylene. The cable lubricated in that way then passes in conventional manner through a cooling vessel.

A second known solution appears in German patent application DE-44 10 456. As in the first document, that document provides for an extruder to cover the core of a cable with a sheath. At the outlet from that extruder there is disposed a coating chamber for applying granules of hard material to the still-hot sheath, which granules are designed to become detached when the cable is inserted in a duct. Finally, the coated cable passes through a cooling vessel.

In both of those two prior solutions, it is necessary to interpose additional equipment between the extruder that is designed to make the sheath and the cooling vessel. That gives rise to a major alteration of the manufacturing line.

In addition, the equipment for depositing the lubricant must be very close to the sheath extrusion head since otherwise it is not possible to control the thickness of the sheath properly. In any event, the additional equipment occupies non-negligible space and such an organization is not favorable for good control over the dimensions of the sheath.

OBJECTS AND SUMMARY OF THE INVENTION

The present invention thus seeks to provide apparatus for making a lubricated cable that does not significantly alter the geometrical characteristics of the cable.

The invention thus provides apparatus for depositing a lubricant coating on a cable, the cable having a sheath made by means of an extruder followed by a cooling vessel, in addition, downstream from said cooling vessel, the apparatus comprises a preparatory treatment member followed by a deposition chamber provided with a lubricant material.

This preparatory treatment member can be a heater member or it can perform treatment by the corona effect on the sheath of the cable.

Advantageously, the lubricant material is based on polytetrafluoroethylene.

It is also possible to provide for the lubricant material to be constituted by microbeads.

In which case, the lubricant material is inorganic, it may be constituted by glass, for example.

In a first embodiment of the apparatus, the lubricant material is deposited in a bath.

In a second embodiment of the apparatus, the lubricant material is deposited by spraying an emulsion or by spraying using a gas.

In a third embodiment of the apparatus, the lubricant material is deposited by means of a calibrated die.

Preferably, the deposition chamber is followed by an evaporator member.

Nevertheless, the above three embodiments are difficult to implement and make it difficult to obtain very good uniformity of the lubricant material.

Thus, in a fourth embodiment of the apparatus, the lubricant material is not granular, and said material is deposited by plasma phase spraying.

The invention also provides a method of using the apparatus, the method including a step of heating the cable sheath and a step of depositing a lubricant material on said sheath.

BRIEF DESCRIPTION OF THE DRAWING

The invention is described below in greater detail with reference to examples given for illustrative purposes with reference to the sole accompanying FIGURE which constitutes a diagram of the apparatus.

MORE DETAILED DESCRIPTION

With reference to the FIGURE, and as in the prior art, an extruder 20 forms the sheath of the cable 11 on a core 10. By way of example, the core of an optical fiber cable is often constituted by a central carrier or strength member, with the fibers being received in helical grooves formed in the periphery of the strength member.

The cable 11 is then cooled in a cooling vessel 21. As mentioned above, it is necessary for the extruder 20 to be very close to the cooling vessel 21 in order to control the thickness of the sheath.

According to the invention, the cable is then directed to a preparatory treatment member 22 for preparing the sheath to receive a deposit.

The member 22 may be a heater member such as an oven or a flame, nevertheless it is necessary to avoid heating the sheath up to its melting point. The temperature of the oven is selected in a manner that is appropriate for the remainder of the method.

This member 22 may also perform treatment by the corona effect, i.e. it may subject the sheath to a flow of ionized gas such as air, for example.

On leaving the preparatory treatment member 22, the cable 22 passes into a deposition chamber 23 to coat the sheath in a layer of lubricant material. This material has a very low coefficient of friction relative to the inside surface of the duct into which the cable is to be engaged.

Substances based on polytetrafluoroethylene are well known for having this mechanical characteristic and they are therefore well suited to this application. Under such circumstances, the deposition chamber may be in the form of a bath having the lubricant material in suspension in solvents, or it may be in the form of a calibrated die likewise fed with material in solution, or indeed it may be a spraying machine which sprays the material as an emulsion.

It is also possible to use microbeads as taught by the second known solution mentioned in the introduction. The microbeads are made of a suitable material, in particular polytetrafluoroethylene. They may also be made of an inorganic material such as glass, quartz powder, or a ceramic. Under such circumstances, deposition is performed by spraying microbeads which are in suspension in an emulsion or in a gas, e.g. compressed air, or indeed by means of a calibrated die.

Nevertheless, the above-described deposition chambers are difficult to implement in such a manner as to control accurately the quantity or the thickness of material that is deposited.

Thus, according to another feature of the invention, the chamber 23 is in the form of a plasma phase spray chamber. It is possible to deposit microbeads in the plasma phase with appropriate equipment which can be derived from the plasma technique used for manufacturing optical fiber preforms.

In addition, since that technique of itself causes the temperature of the sheath to rise, it can be possible for there to be no need for an independent heater member, with the deposition chamber 23 simultaneously performing the heating and deposition functions.

If necessary, an evaporator member 24 may be placed at the output from the deposition chamber 23 to evaporate off the solvent used as a vehicle for the lubricant material. The evaporator member will also be in the form of an oven.

The invention is not limited to the embodiments described above. In particular, it is possible to replace any means by equivalent means.

What is claimed is:

1. A method of depositing a lubricant coating on a cable, the cable having a sheath made by means of an extruder followed by a cooling vessel, said method comprising the steps of:

passing said cable through a preparatory station downstream from said cooling vessel to apply a preparatory treatment to said sheath; and depositing said lubricant material on said sheath in a deposition station downstream of said preparatory treatment station.

2. A method according to claim 1, wherein said preparatory treatment comprises heating.

3. A method according to claim 1, wherein said preparatory treatment comprises performing a corona effect treatment on said sheath.

4. A method according to claim 1, wherein said lubricant material is based on a polytetrafluoroethylene.

5. A method according to claim 1, wherein said lubricant material is inorganic.

6. A method according to claim 5, wherein said lubricant material is glass.

7. A method according to claim 1, wherein said lubricant material comprises microbeads.

8. A method according to claim 1, wherein said deposition station comprises a bath.

9. A method according to claim 1, wherein said lubricant material is an emulsion and said deposition station comprises a spraying machine.

10. A method according to claim 1, wherein said deposition station comprises a calibrated die.

11. A method according to claim 1, wherein said deposition station comprises a gas spray station.

12. A method according to claim 1, further comprising the step of passing said cable through an evaporator station downstream of said deposition station.

13. A method according to claim 1, wherein said lubricant material is not granular, and said deposition station comprises a plasma phase deposition chamber.

* * * * *